US007111526B1

(12) United States Patent
Flojo

(10) Patent No.: US 7,111,526 B1
(45) Date of Patent: Sep. 26, 2006

(54) CLAMP PIN FOR USE BY ELECTRICIAN OR ELECTRICAL LINEWORKER

(75) Inventor: Alfred R. Flojo, Chicago, IL (US)

(73) Assignee: Norcross Safety Products, L.L.C., Skokie, IL (US)

( * ) Notice: Subject to any disclaimer, the term of this patent is extended or adjusted under 35 U.S.C. 154(b) by 0 days.

(21) Appl. No.: 11/124,819

(22) Filed: May 9, 2005

(51) Int. Cl.
*B25B 23/16* (2006.01)
*B25B 7/12* (2006.01)

(52) U.S. Cl. ..... 81/53.1; 81/3.48; 81/351; 294/118

(58) Field of Classification Search ..... 81/53.1, 81/302, 487, 485, 350, 351, 348, 417, 3.48, 81/3.8; 294/118
See application file for complete search history.

(56) References Cited

U.S. PATENT DOCUMENTS

| | | | | |
|---|---|---|---|---|
| 205,488 | A * | 7/1878 | Kneerson | 294/118 |
| 1,539,302 | A * | 5/1925 | Curtis | 81/348 |
| 2,291,593 | A | 7/1942 | Hubbard | |
| 2,316,428 | A | 4/1943 | Heinrich | |
| 2,319,992 | A | 5/1943 | Hubbard | |
| 2,514,063 | A | 7/1950 | Hubbard | |
| 2,637,088 | A * | 5/1953 | Foster | 294/118 |
| 2,966,817 | A * | 1/1961 | Wengen | 81/53.1 |
| 2,980,456 | A | 4/1961 | McMullin | |
| 3,103,375 | A | 9/1963 | McMullin | |
| 4,047,821 | A | 9/1977 | Hoke et al. | |
| 4,079,978 | A | 3/1978 | McMullin | |
| 4,242,930 | A | 1/1981 | Myers et al. | |
| 5,143,414 | A * | 9/1992 | Rosellini | 294/99.2 |
| 5,294,162 | A * | 3/1994 | Grimes | 294/118 |
| 5,593,196 | A | 1/1997 | Baum et al. | |

OTHER PUBLICATIONS

Fig. A described in Background of the Invention, paragraphs one through four, admitted prior art.
Fig. B described in Background of the Invention, paragraph five, admitted prior art.

* cited by examiner

*Primary Examiner*—Hadi Shakeri
(74) *Attorney, Agent, or Firm*—Wood, Phillips, Katz, Clark & Mortimer

(57) ABSTRACT

A clamp pin has two clamping jaws, each having a clamping arm and an actuating arm. Being connected pivotably to each other between the clamping and actuating arms, the clamping jaws are pivotable between a condition in which the clamping arms are opened and a condition in which the clamping arms are closed and toward which the clamping jaws are biased. The clamp pin has two actuating links, each having a upper end, which is connected pivotably to the actuating arm of one of the clamping jaws, and each having a lower end. The actuating links are connected pivotably to each other at the lower ends, via a grommet. The clamp pin is useful and may be advantageously combined with a clamp stick having a socket and having a hook movable into and out from the socket, wherein the grommet is adapted to receive the hook and wherein the actuating links are adapted to be drawn into the socket, along with the hook, when the hook is received by the grommet.

4 Claims, 2 Drawing Sheets

CLAMP PIN FOR USE BY ELECTRICIAN OR ELECTRICAL LINEWORKER

TECHNICAL FIELD OF THE INVENTION

This invention pertains to a clamp pin of a type used by an electrician or an electrical lineworker to clamp an insulative blanket around a live electrical conductor or another electrical hazard. The clamp pin is used with a clamp stick of a type used by an electrician or an electrical lineworker for diverse tasks.

BACKGROUND OF THE INVENTION

As known heretofore and available commercially from Salisbury of Skokie, Ill., and from other sources, a clamp pin of the type noted above is made except for small parts, such as a torsion spring, from a dielectric material, either a hardwood or a suitable polymer, such as fiberglass-reinforced nylon. Such a pin has two clamping jaws, each of which has a clamping end and an actuating arm, which are connected pivotably to each other, which are pivotable between an opened condition and a closed condition, and which are biased toward the closed condition.

In the opened condition, the clamping ends are drawn apart from each other and the actuating arms are drawn toward each other. In the closed condition, the clamping ends are drawn toward each other and the actuating arms are drawn apart from each other. The clamping jaws may have rubber boots covering the lower ends of the clamping ends.

As known heretofore and available commercially from Salisbury of Skokie, Ill., and from other sources, a clamp stick of the type noted above, a so-called "shotgun" in trade parlance, has a tubular, dielectric body with a gripping end and with a working end having a socket. Such a stick also has an operating rod, which terminates in a hook that is movable into and out from the socket and which is manipulatable via means near the gripping end.

The actuating arms of a clamp pin of the type noted above can be manually drawn toward each other, whereupon the actuating arms thereof can be manually pushed partly into the socket of the clamp stick, toward or against the hook of the clamp stick. If the operating rod of the clamp stick is manipulated so as to move the hook out of the socket, the actuating arms thereof can be then pushed out from the socket so that, as the clamping jaws are biased, the clamping arms are drawn toward each other in a snapping action. Thus, the clamp stick is useful in installing the clamp pin, which is aligned with the clamp stick when the clamp pin is being installed. Disadvantageously, however, the clamp stick is not useful in removing the clamp pin.

Moreover, it has been known heretofore to provide a clamp pin, as available commercially from Salisbury of Skokie, Ill., and from other sources, with a wire extending through aligned holes in the actuating arms and being provided with a loop at each end. If one of the loops is engaged by the hook of a clamp stick of the type noted above and is pulled into the socket of the clamp stick, the other loop bears on one of the actuating arms so as to draw the actuating arms together. Thus, the clamp stick is useful not only in installing the clamp pin but also in removing the clamp pin. Disadvantageously, however, the clamp pin is not aligned with the clamp stick when the clamp pin is being installed or when the clamp pin is being removed.

Clamp sticks if the type noted above are exemplified in U.S. Pat. No. 2,316,428, U.S. Pat. No. 2,514,063, and U.S. Pat. No. 4,242,930, the disclosures of which are incorporated herein by reference.

SUMMARY OF THE INVENTION

The clamp pin provided by this invention is similar to clamp pins known heretofore in comprising two clamping jaws, each having a clamping arm and an actuating arm. The clamping jaws are connected pivotably to each other between the clamping and actuating arms. The clamping jaws are pivotable between an opened condition, in which the clamping arms are drawn apart from each other and in which the actuating arms are drawn toward each other, and a closed condition, in which the clamping arms are drawn toward each other and in which the actuating arms are drawn apart from each other, the clamping jaws being biased toward the closed condition.

The clamp pin provided by this invention differs from clamp pins known heretofore in comprising two actuating links. Each actuating link has an upper end, which is connected pivotably to the actuating arm of a given one of the clamping jaws, and each actuating link has a lower end. The actuating links are connected pivotably to each other at the lower ends.

The clamp pin provided by this invention may be advantageously combined with a clamp stick having a socket and having a hook movable into and out from the socket, in a combination wherein the actuating links are adapted to be drawn into the socket, along with the hook, when the hook coacts with the actuating links where the actuating links are connected pivotably to each other at the lower ends.

Preferably, the actuating links are connected pivotably to each other at the lower ends, via grommet, whereupon the clamp pin provided by this invention may be advantageously combined with a clamp stick having a socket and having a hook movable into and out from the socket, in a combination wherein the grommet is adapted to receive the hook of the clamp stick and wherein the actuating links are adapted to be drawn into the socket, along with the hook, when the hook is received by the grommet.

Herein, the terms "upper" and "lower" are used to refer to ends of certain elements of the clamp pin in a useful orientation, in which the clamp pin is illustrated in the accompanying drawings, but are not intended to limit the clamp pin to any particular orientation.

DETAILED DESCRIPTION OF THE ILLUSTRATED EMBODIMENT

As illustrated in FIGS. 1 through 5, a clamp pin 10 embodying this invention is similar to clamp pins known heretofore in certain respects but differs from clamp pins known heretofore in other respects, which facilitate its use with a clamp stick 100 of the type noted above.

Figure 1:
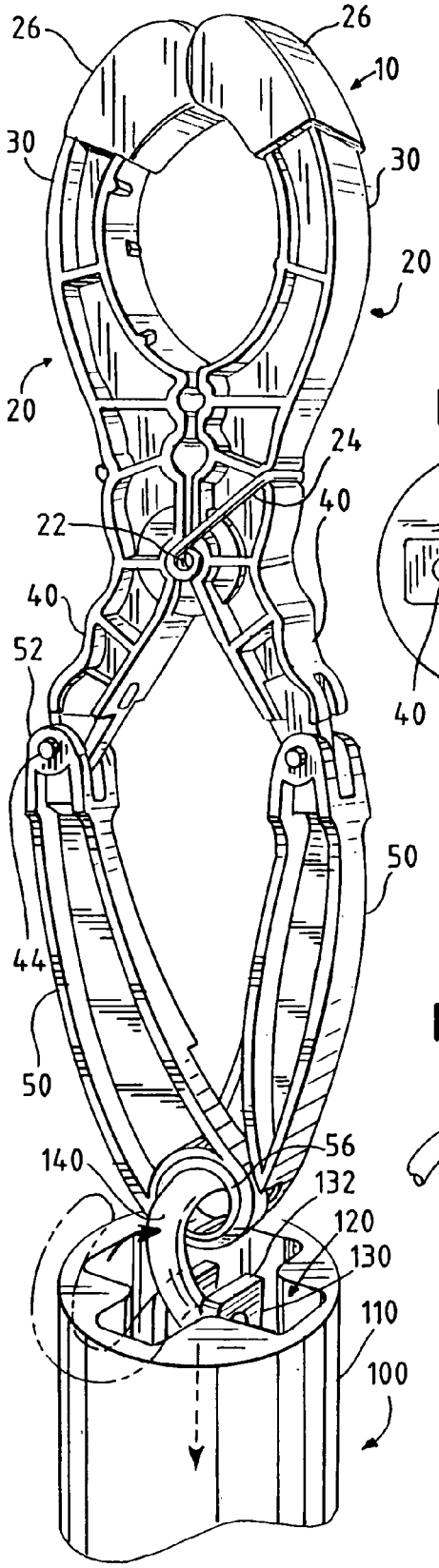
FIG. 1 is a pictorial view of clamp pin embodying this invention, as employed with a clamp stick, which is illustrated fragmentarily. Two actuating links of the clamp pin are connected pivotably to each other, via a grommet, which receives a hook of clamp stick. The clamp pin is illustrated in a closed condition, in which the actuating arms have not been pulled into a socket of the clamp stick.
Figure 4:
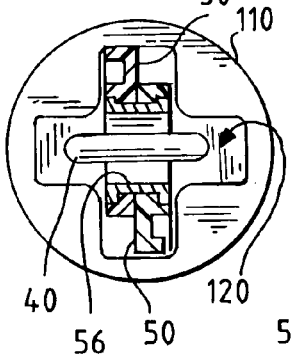
FIG. 4 is a sectional view, as taken along line 4—4 of FIG. 3, in a direction indicated by arrows.
Figure 2:
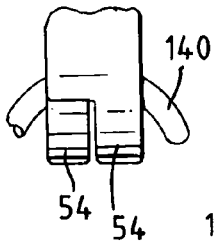
FIG. 2 is a fragmentary detail of the lower ends of the actuating links and of the hook.
Figure 3:
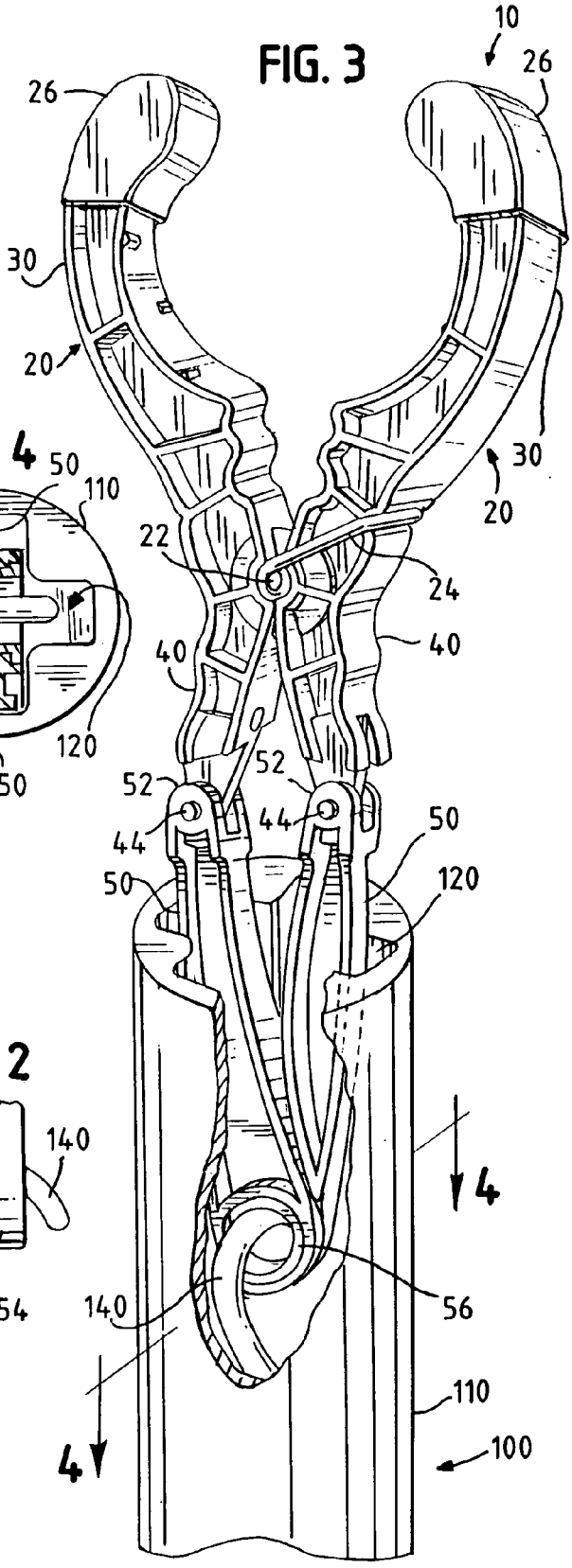
FIG. 3 is a pictorial view of the clamp pin, as illustrated in an opened condition, in which the actuating arms have been pulled by the hook partly into the socket of the clamp stick.

The clamp pin 10 is similar to clamp pins known heretofore in comprising two clamping jaws 20, each having a clamping arm 30 and an actuating arm 40. The clamping jaws 20 are connected pivotably to each other, via the core 22 of a torsion spring 24, between the clamping and actuating arms 30, 40. The clamping jaws 20 are configured so as to be thus pivotable between a closed condition, in which the clamping jaws 20 are illustrated in FIG. 1, and an opened condition, in which the clamping jaws 20 are illustrated in FIGS. 2 and 3. The clamping jaws 20 are biased, via the torsion spring 24, toward the closed condition. Each clamping jaw 20 has a rubber boot 26 covering the upper end of the clamping arm 30 of said clamping jaw. Except for the rubber boots 26 and the torsion spring 24, which is made from steel, the clamping jaws 20 are made from fiberglass-filled nylon, which is dielectric.

Figure 5:
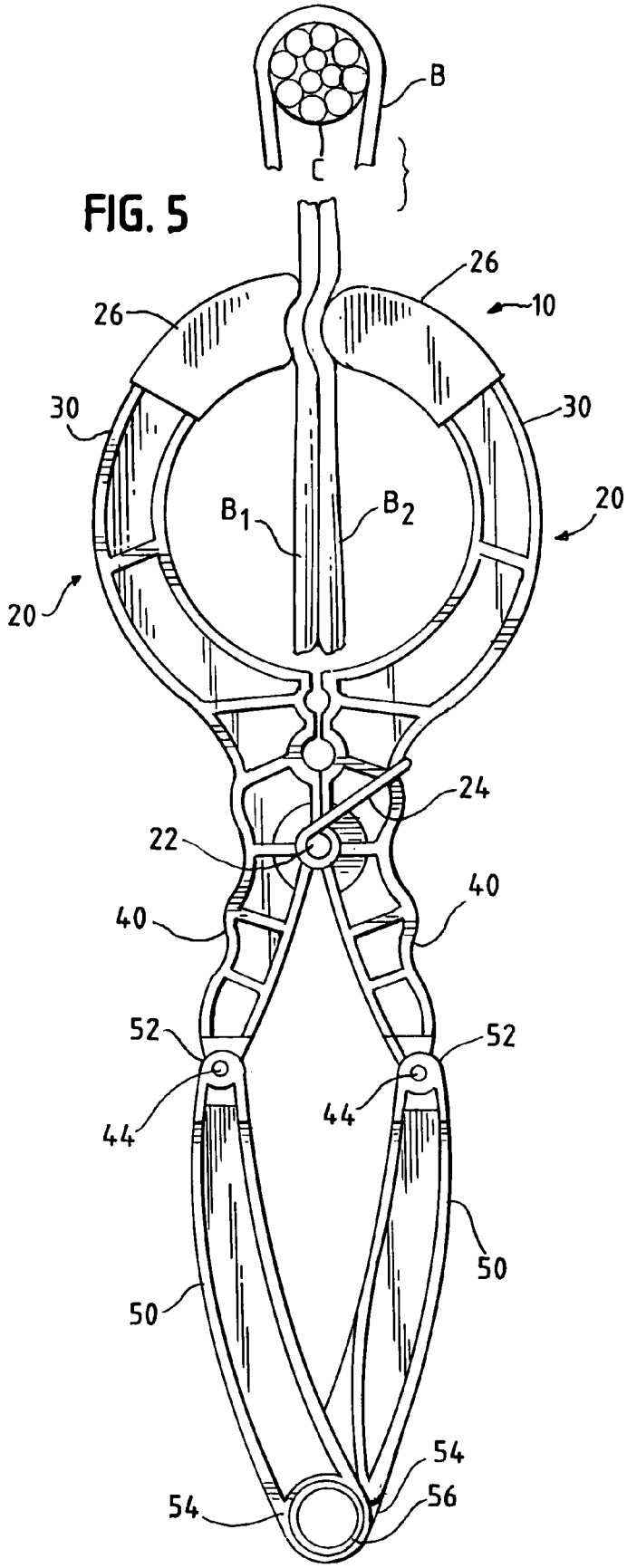
FIG. 5 is an elevational view of the clamp pin, as employed to clamp two layers of an insulative blanket, which is draped over an electrical conductor.

In the closed condition, the clamping arms 30 are drawn toward each other, until the rubber boots 26 covering their tips touch each other if nothing is clamped between the rubber boots 26, and the actuating arms 40 are drawn apart from each other. In the opened condition, the clamping arms 30 are drawn apart from each other and the actuating arms 40 are drawn toward each other. In the opened condition, however, the tips of the actuating arms 40 remain separated. As illustrated in FIG. 5, because the clamping jaws 20 are biased toward the closed condition, the clamp pin 10 is useful for clamping items, such as two layers $B_1$, $B_2$, of an insulating blanket B draped over an electrical conductor C, between the rubber boots 26.

The clamp pin 10 differs from clamp pins known heretofore in comprising two actuating links 50. Each actuating link 50 has a upper end 52, which is connected pivotably to the lower end 42 of the actuating arm 40 of a given one of the clamping jaws 20, via a pivot pin 44, and each actuating link 50 has a lower end 54. The actuating links 50 are connected pivotably to each other, at the lower ends 54, via a grommet 56. Except for the pivot pins 44, which are made from steel, and except for the grommet 56, which is made from steel, the actuating links 50 are made from fiberglass-filled nylon, which is dielectric.

The clamp stick 100, which is illustrated fragmentarily, has an elongate, dielectric body 110 with a working end, which is illustrated, and a gripping end, which is not illustrated. The elongate, dielectric body 110 defines a socket 120, which is cross-shaped in cross-section, and houses an operating rod 130, which has a bifurcated end 132 mounting a hook 140, which is movable into and out from the socket 120, as the operating rod 130 is manipulated by means, not illustrated, near the gripping end.

As disclosed in U.S. Pat. No. 4,242,930, and as suggested via broken lines and a curved arrow in FIG. 1, the hook 140 is mounted pivotably to the bifurcated end 132 of the operating rod 130 and is biased so as to pivot to one side, whereby more easily to hook onto an object, when the hook 140 has been moved out from the socket 120. Moreover, the hook 140 is adapted to pivot back, whereby more securely to retain an object hooked onto the hook 140, when the hook 140 has been moved into the socket 120.

The grommet 56 is adapted to receive the hook 140, whereupon the actuating links 50 can be then drawn into the socket 120, along with the hook 140, when the hook 140 is moved into the socket 120 via the operating rod 130 and whereupon the actuating links 50 can be then moved out from the socket 120, along with the hook 140, when the hook 140 is moved out from the socket 120 via the operating rod 130. When the actuating links 50 are drawn into the socket 120, the upper ends 52 of the actuating links 50 are drawn toward each other, whereupon the actuating arms 40 of the clamping jaws 20 are drawn toward each other and the clamping arms 30 of the clamping jaws 20 are drawn apart from each other. When the actuating links 50 are moved out from the socket 120, the upper ends 52 of the actuating links 50 are drawn apart from each other, whereupon the actuating arms 40 of the clamping jaws 20 are drawn apart from each other and the clamping arms 30 of the clamping jaws 20 are drawn toward each other.

Advantageously, therefore, the clamp pin 10 remains aligned with the clamp stick 100 not only when the clamp pin 10 is being installed but also when the clamp pin is being removed.

The invention claimed is:

1. A controllable clamp for use by electrical workers, comprising:

a clamping pin having two clamping jaws, each having a clamping arm and an actuating arm, the clamping jaws being connected pivotably to each other between the clamping and actuating arms and being pivotable between an opened condition, in which the clamping arms are drawn apart from each other and in which the actuating arms are drawn toward each other, and a closed condition, in which the clamping arms are drawn toward each other and in which the actuating arms are drawn apart each other, the clamping jaws being biased toward the closed position, and two actuating links, each actuating link having an upper end, which is connected pivotably to the actuating arm of a given one of the clamping jaws, each actuating link having a lower end, the actuating links being connected pivotably to each other at the lower ends by a grommet; and a clamping stick having a socket, and a hook removably receivable in said clamping pin grommet and movable into and out from the socket;

wherein said pivotably connected lower ends of said actuating links are receivable in said socket;

wherein said socket is defined by outer sides of said clamping stick; and said actuating links are movable into said socket by controlled movement of said hook into said socket wherein said clamping jaws are moved toward said open condition by said socket defining outer sides pivotably moving said actuating links together as said grommet moves into said socket.

2. The controllable clamp of claim 1, wherein said socket outer sides are cam surfaces controlling the pivotal position of said actuating links when said actuating links are in said socket.

3. The controllable clamp of claim 1, wherein said actuating links are controllably pivotable between a first position in said clamping stick socket wherein said actuating links are held between said socket defining outer sides whereby said clamping jaws are in said opened condition, and a second position in which said actuating links are outside said clamping stick socket whereby said clamping jaws are biased to said closed condition.

4. The controllable clamp of claim 1, whereby in said closed condition said actuating links are pivotably oriented so as to slide along said socket defining side walls and be progressively pivoted together as said actuating links are pulled into said socket.

* * * * *

UNITED STATES PATENT AND TRADEMARK OFFICE

CERTIFICATE OF CORRECTION

PATENT NO. : 7,111,526 B1
APPLICATION NO. : 11/124819
DATED : September 26, 2006
INVENTOR(S) : Alfred R. Flojo It is certified that error appears in the above-identified patent and that said Letters Patent is hereby corrected as shown below:

Column 4, line 39, after "apart" insert --from--.

Signed and Sealed this

Twelfth Day of June, 2007

JON W. DUDAS
*Director of the United States Patent and Trademark Office*